United States Patent [19]

Hodson

[11] Patent Number: 4,591,023

[45] Date of Patent: May 27, 1986

[54] LEVELLING DEVICE FOR LADDERS

[76] Inventor: Baden L. Hodson, 29 Stirling Street, Enoggera, Queensland 4051, Australia

[21] Appl. No.: 732,731

[22] Filed: May 10, 1985

[30] Foreign Application Priority Data

Nov. 23, 1984 [CA] Canada ..... 468507

[51] Int. Cl.[4] ..... E06C 7/44

[52] U.S. Cl. ..... 182/200; 182/107

[58] Field of Search ..... 182/200, 201, 202, 107, 182/108; 248/188.3, 188.1

[56] References Cited

U.S. PATENT DOCUMENTS

| | | | |
|---|---|---|---|
| 1,928,158 | 9/1933 | Ruse | 182/200 |
| 2,289,499 | 7/1942 | Husted | 182/202 |
| 2,555,036 | 5/1951 | Husted | 182/202 |
| 2,835,427 | 5/1958 | Balcar | 182/202 |
| 2,960,182 | 11/1960 | Swanson | 182/200 |
| 4,456,095 | 6/1984 | Hodson | 182/200 |

FOREIGN PATENT DOCUMENTS

| | | | |
|---|---|---|---|
| 655493 | 7/1951 | United Kingdom | 182/200 |

*Primary Examiner*—Reinaldo P. Machado
*Attorney, Agent, or Firm*—Kimmel, Crowell & Weaver

[57] ABSTRACT

Modifications in a levelling device for ladders and the like are provided. Apertured lug, adapted for attachment to the bottom ends of uprights, stiles or legs of a ladder, trestle, etc., are slidably mounted on an arcuate support bar, and biased to a non-locking or freely slidable position. On application of weight to the ladder, the apertured lugs pivot to a locking position. In one embodiment, each of the apertured lugs is formed with extension members or fingers with abutment surfaces extending parallel to the plane of the ladder which tangentially engage the sides of the support bar when the apertured lugs are in locked position to prevent or limit any tiltable movement of the support bar out of the plane of the ladder. In another aspect of the invention, the lugs are provided with non-circular apertures and the support bar is formed with a complementary non-circular cross-sectional configuration, such as triangular, square, etc., which configurations prevent rotation of each apertured lug around the support bar, and thus prevent or limit tilting of the support bar out of the plane of the ladder. The levelling device of the present invention may be used on any number of different sizes of ladder to provide stable and safe levelling of the ladder.

7 Claims, 9 Drawing Figures

FIG. 2
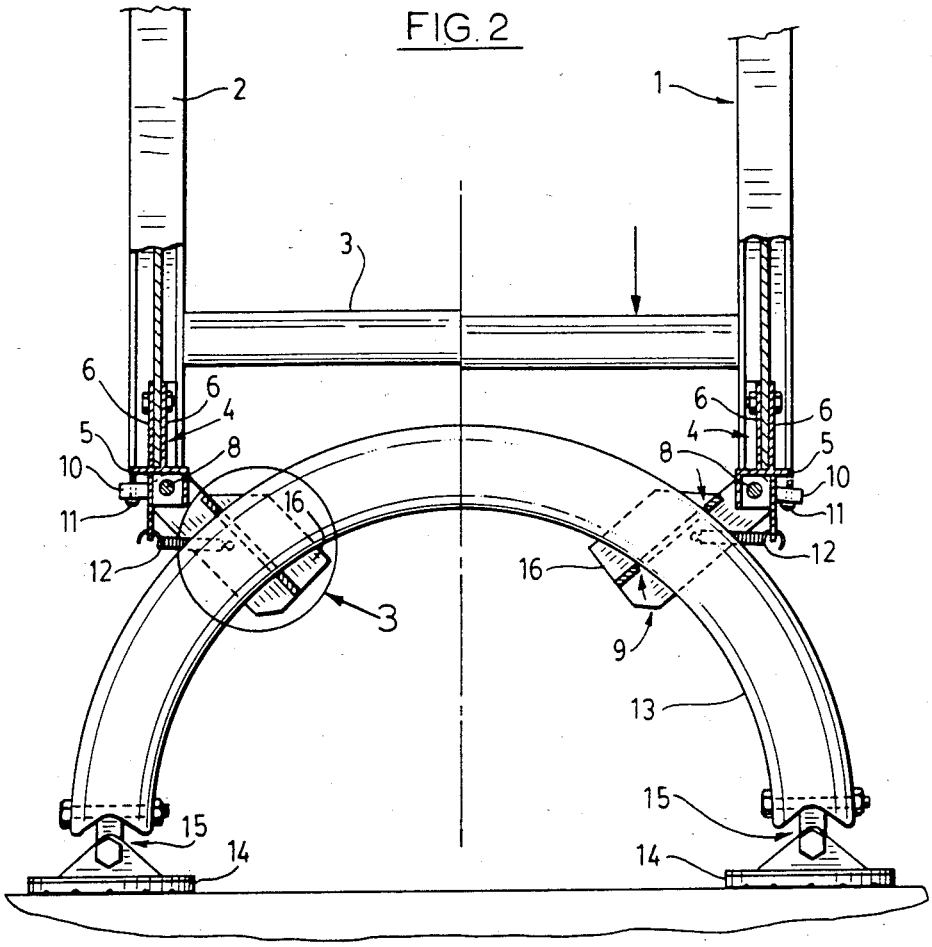
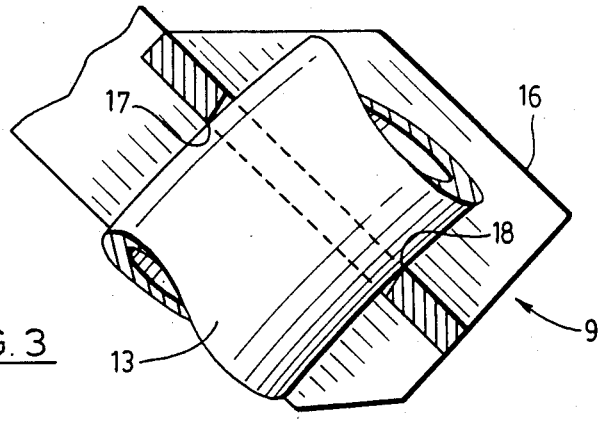
FIG. 3

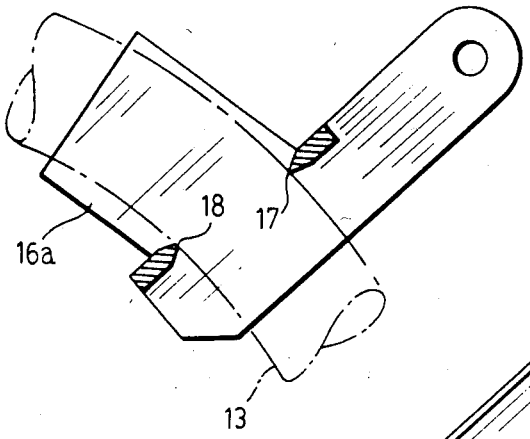
FIG. 4
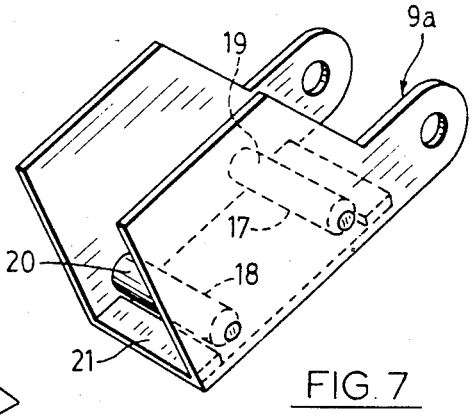
FIG. 7
FIG. 6
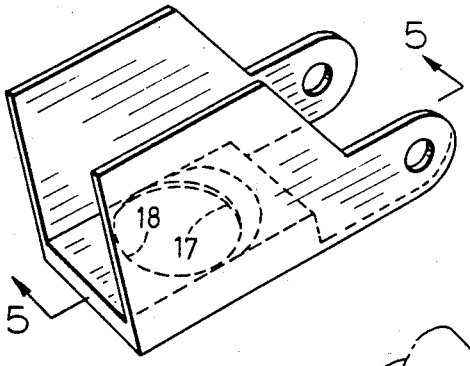
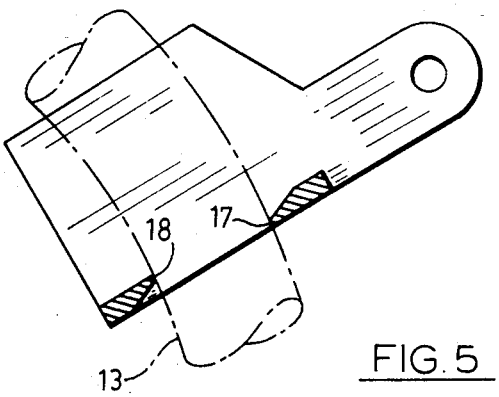
FIG. 5

LEVELLING DEVICE FOR LADDERS

BACKGROUND OF THE INVENTION

1. Field of the Invention

This invention relates to a levelling device for ladders and the like.

2. Description of the Related Art

Difficulties have often been experienced in providing a firm and level foundation for a ladder when used on sloping or uneven ground. Various levelling devices which eliminate the need to support one leg of the ladder on blocks or packing pieces have been proposed. One such levelling device is disclosed in British Application No. 16660/48 (Hannington) published July 25, 1951. A serious disadvantage of this prior device, however, is that it cannot eliminate chatter of the friction locking devices when levelling initally. Hannington's friction devices can, and do, slip. Also because of its design, when weight is placed on the ladder, the arc is forced so far out of the plane of the ladder as to be dangerous to the user.

A more stable ladder levelling device is disclosed in my Canadian Letters Pat. No. 1,162,896, which issued on Feb. 28, 1984. The disadvantage of this device, however, is that it cannot be readily adapted for ladders of different widths.

SUMMARY OF THE INVENTION

The present invention provides an improved ladder levelling device which can readily be used with ladders of different widths and which is quite stable in use.

According to one aspect of the invention, a ladder levelling device is provided consisting of an arcuate support bar terminating in ground-engaging feet, and means for attaching the support bar to the side poles of a ladder to be supported. These attaching means include, for each side pole, a bracket for attachment to the bottom end of the respective side pole and an apertured lug through which the support bar passes in sliding engagement therewith. The lug is pivotally connected to the bracket for pivotal movement in the plane of the ladder whereby it is adapted to grip the support bar and lock it to the side pole at any position at which it is set when the weight of the ladder is applied to the support bar through the attaching means. Each lug is formed with an extension arm having an abutment surface extending parallel to the plane of the ladder. This extension arm is movable in accordance with pivotal movement of the lug to bring the abutment surface into tangential engagement with the support bar to prevent tilting of the ladder relative to the support bar when the lug is moved into the locking position.

Preferably each lug is formed with a pair of extension arms having opposed abutment surfaces which are brought into tangential engagement with opposite sides of the support bar when the lug is moved to the locking position.

Further, the attaching means preferably includes means for resiliently biasing the pivoted lugs to a non-locking position for freeing the arcuate support bar for slidable movement therethrough, when the weight of the ladder is removed from the ladder levelling device by lifting the ladder.

According to another aspect of the invention, there is provided a ladder levelling device consisting of an arcuate support bar terminating in ground-engaging feet, and means for attaching the support bar to the side poles of the ladder to be supported. These attaching means include, for each side pole, a bracket for attachment to the bottom end of the respective side pole and an apertured lug through which the support bar passes in sliding engagement therewith. The lug is pivotally connected to the bracket for pivotal movement in the plane of the ladder whereby it is adapted to qrip the support bar and lock it to the side pole at any position at which it is set when the weight of the ladder is applied to the support bar through the attaching means. The aperture of each lug is non-circular and the arcuate support bar is of complementary non-circular cross-section.

Suitable configurations of the cross-section of the arcuate member and the corresponding keyway, in order to maintain the locking means against cross-movement relative to the slidable movement of the arcuate member, could be in the form of squares, triangles, etc.

BRIEF DESCRIPTION OF THE DRAWINGS

FIG. 2 is a split side elevational view of the ladder levelling device mounted at the bottom of a ladder, wherein the left-hand side illustrates an apertured lug of the attaching means in a position to allow free slidable movement of the arcuate support bar and the right-hand side illustrates an apertured lug in a locking position on the arcuate support bar;

FIG. 3 is an enlargement of the left-hand side illustration of the apertured lug of FIG. 2;

FIGS. 4 and 5 are cross-sectional views of different embodiments of an apertured lug of the present invention having non-coplanar upper and lower gripping edges;

FIG. 6 is a perspective phantom view of the embodiment of FIG. 5;

FIG. 7 is a view, similar to FIG. 6, of a different embodiment of an apertured lug from either FIGS. 4 or 5;

DESCRIPTION OF THE PREFERRED EMBODIMENT

Figure 1:
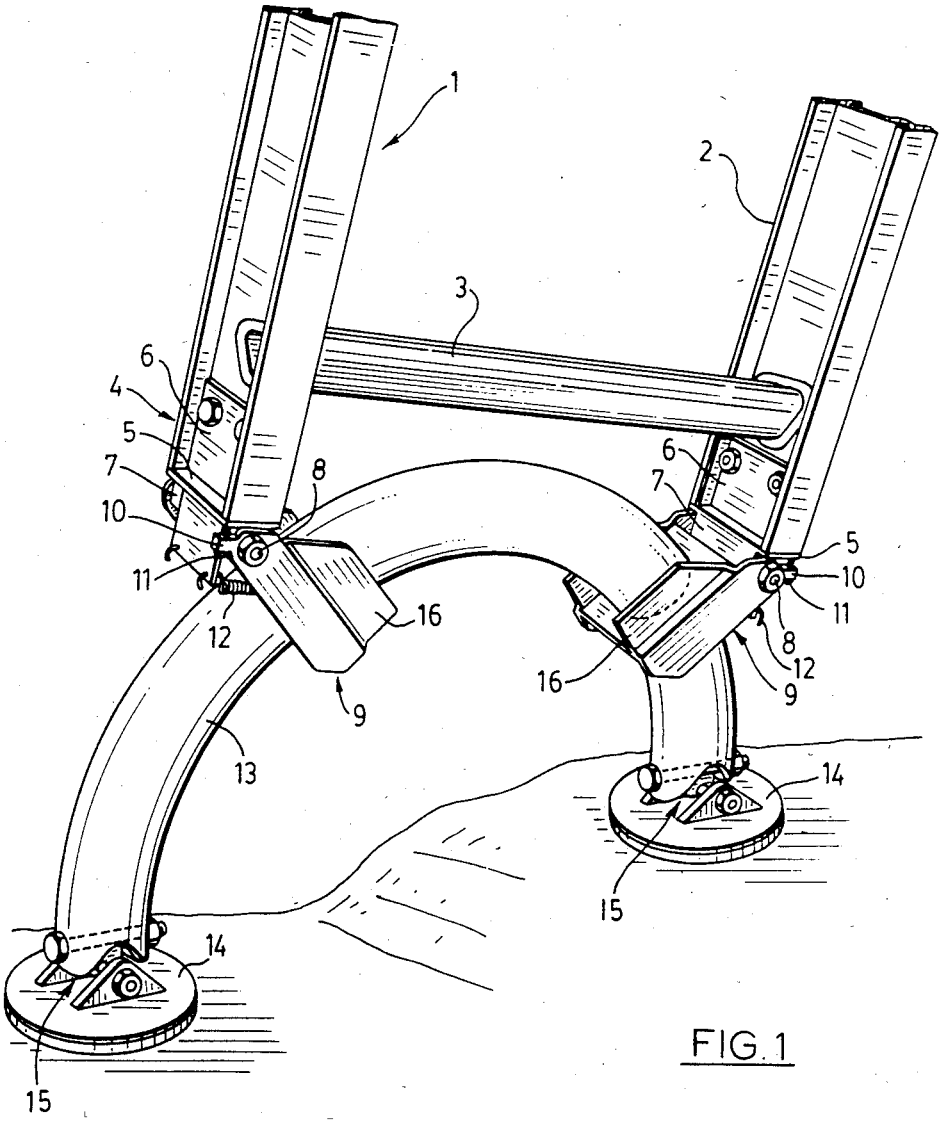
FIG. 1 is a perspective view of one embodiment a ladder leveling device of the present invention mounted at the bottom of a ladder.

Referring now to FIG. 1, a ladder 1 has a pair of substantially parallel side poles 2 interconnected by a plurality of equally spaced rungs 3, only one of which is shown.

A mounting bracket 4 is fitted to the bottom end of each side pole 1. Each mounting bracket 4 has a base plate 5 and parallel upright plates 6, and the parallel upright plates 6 are secured to the side poles 2 by suitable fasteners (e.g. rivets or screws) or by welding.

A block 7 secured to the base plate 5 is internally bushed to receive a bolt 8 on which is pivotally mounted an apertured lug 9. A pin 10 extends outwardly from one side of each appertured lug 9 and is provided with an adjustable stud 11 which can bear against the base plate 5 to limit the pivotal of movement of the apertured lugs 9 in the unlocked or "home" position. Springs 12 resiliently bias the lugs downwardly, forcing the stud 11 into contact with the base plate 5.

An arcuate support bar 13, formed from metal tube bent to substantially semi-circular form, passes through the apertured lugs 9 and is provided with feet 14 connected to the support bar 3 by universal joints 15.

Extension members 16 in the form of inwardly extending arms or plates are formed on opposite sides of each apertured lug with abutment surfaces extending parallel to the plane of the ladder. These extension members may be formed as separate members and affixed to the appertured lugs, for example by welding, or they may be formed integrally with the lugs, for example, where the lugs are formed of sheet metal, or by moulding or casting.

The extension members 16 are formed on each apertured lug so as to tangentially engage the side of the support bar 13 when that apertured lug is pivoted against the bias of spring 12.

Referring now to FIGS. 2 and 3, it can be seen that the upper and lower walls of each lug 9 are offset in their engagement of the support bar 13, and form non-coplanar upper and lower gripping edges 17 and 18.

As shown in the lefthand side of FIG. 2, when no load is placed on the ladder 1, the springs 12 operating on the apertured lugs 9 urge them downwardly to an unlocked position, to enable the support bar to slide freely through the apertures in the lugs 9. The downward movement of each lug 9 is limited by its stud 11, allowing only enough movement for free sliding of the support bar therethrough. The extension members 16, when each lug 9 is in its unlocked position, extend below the support bar 13, and their abutment surfaces are free from engagement with the sides of the support bar 13.

As shown on the righthand side of FIG. 2, when a load is applied to the ladder, the lugs 9 are swung upwardly relative to the ladder and the upper and lower gripping edges 17 and 18 of the apertured lugs 9 engage and grip the support bar 13 to prevent relative movement between the support bar 13 and the lugs 9. At the same time, the extension members 16 also swing upward on the same pivot axes as the apertured lugs 9 and their abutment surfaces tangentially engage the sides of the support bar 13 and bear against the support bar 13 preventing it from being tilted out of the plane of the ladder.

If preferred, an extension member 16 may be provided on only the rear side of each apertured lug, the rear side being the side which would face a wall when the ladder is positioned for use.

As shown in FIG. 4 and as described in my Canadian Patent No. 1,162,896, the locking means is most effective when the upper and lower gripping edges 17 and 18, formed by the inwardly facing walls of the aperture in each lug 9, have a different axial offset between them relative to the pivot axis of the lug 9 when it is pivotally mounted on the mounting bracket 4.

This non-coplanar engagement of the upper and lower gripping edges 17 and 18 on the support bar 13, increases the effective area of the aperture in the lug 9 when they are pivoted to the full extent to enable the support bar 13 (shown in broken outline) to pass freely through the aperture of the lug 9. When the lug 9 is tilted upward by application of load to the ladder, the gripping edges 17 and 18 firmly engage opposite faces of the support bar 13. The offset of the gripping edges 17 and 18 provides a more effective lock against sliding of the support bar 13, since the force of the locking action bears against the support bar 13 diagonally, rather than through a perpendicular cross-section of the support bar.

It has also been found that non-coplanar gripping edges may be provided in the lugs 9 as illustrated in FIG. 5. An apertured lug 9 may be formed of sheet metal, and on the aperture, its walls may be conversely angled on opposite sides to form the offset gripping edqes 17 and 18. To accomplish this, the aperture should be formed (e.g. by stamping) with a relief of metal under one side and on top of the other side.

A modification of an extension member 16 in the form of a finger **16*a* is illustrated in FIG. 4, and it can be seen that the finger 16*a* is provided with an abutment surface which will tangentially engage the support bar 13 to prevent tilting of the ladder on pivoting of the apertured lug 9** to its locking position.

Fiqure 6 illustrates a perspective view of the particular configuration of gripping edges 17 and 18 of FIG. 5.

FIG. 7 illustrates a further embodiment of the apertured lug 9 wherein the gripping edges 17 and 18 of the aperture are formed by a pair of upper and lower rollers 19 and 20, which are internally bushed and are mounted by bolting between opposite extension members 16 of each lug.

The axial offset of the gripping edges 17 and 18 is maintained by the positioning of rollers 19 and 20, the lower roller 20 being positioned slightly higher from the bottom edge of the lug **9*a* than the upper roller 19. The spacers 21 between the two sides of lug 9*a*** provide rigidity for the locking faces.

The embodiment of FIG. 7 can be further modified by replacing upper roller 19 with a fixed locking plate presenting the upper gripping edge 17, or conversely replacing lower roller 20 with a fixed locking plate presenting the lower gripping edge 18.

The cross-sectional configuration of the support bar 13, as shown in FIGS. 1 through 6, is circular. From FIGS. 7, 8 and 9, it can be seen that the aperture in the lug 9 can be non-circular with the support bar 13 being of complementary non-circular cross-section. This produces a "keyway" in the aperture of the lug 9 which still provides for free sliding of the support bar 13 therethrough when the lugs 9 are not in the locking position. The "keyway" formed by the aperture of the lug 9 also provides a relatively close fit to prevent excessive sideways movement of the support bar 13 in the apertures.

It can be seen that the aperture formed between the rollers 19 and 20 of the lug **9*a* in FIG. 7** would receive a support bar having a square cross-section (not shown).

Figure 8:
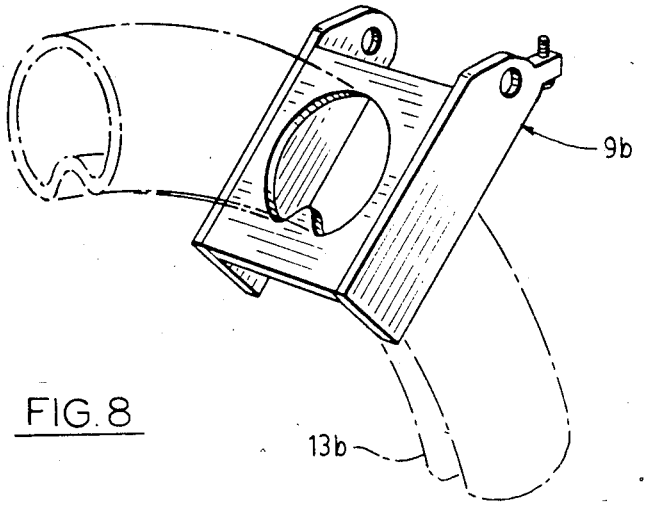
FIG. 8 is a perspective view of a lug having a non-circular aperture mounted on a support bar having a complementary non-circular cross-section.

In FIG. 8 the aperture of the lug **9*b* has been formed as a substantially circular keyway having an inwardly protruding bead on the aperture's lower wall. The support bar 13*b*, shown in phantom outline, has been formed with a complementary cross-section which is substantially circular, but with an elongated dimple in which the protruding bead of the apertured lug 9*b*** *can slide.*

Figure 9:
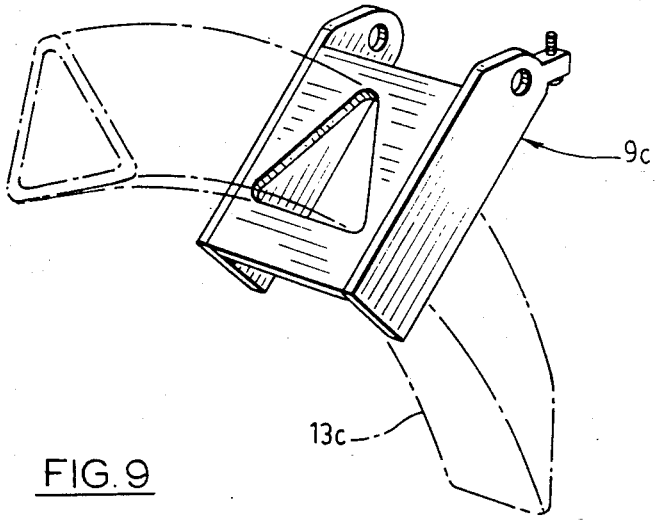
FIG. 9 is a view, similar to FIG. 8, of a different embodiment thereof.

In FIG. 9, the aperture of the lug **9*c* is triangular in shape, as is the complementary cross-section of the support bar 13*c*, shown in phantom outline, on which the lug 9*c*** is slidably mounted.

In the configurations illustrated in both FIGS. 8 and 9, the form of lugs **9*b* and 9*c* having gripping edges illustrated in FIG. 5 have been utilised. However, it will be obvious that the configuration illustrated in FIG. 4 or any obvious modification thereof may be utilised to provide gripping edges which have an offset between them so as to firmly lock the lugs 9***b* and 9*c* onto their respective support bars 13*b* and 13*c*.

Configurations such as those illustrated in FIGS. 8 and 9, as well as other non-circular shapes, prevent the locking device from rotating around the support bar. Hence, such configurations in the levelling device aid in preventing the support bar from being tilted out of the plane of the ladder.

The use of non-circular configurations fulfills the same function as the extension members 16. In the case of circular tubing on the support bar, the stress resulting from weight being placed on the ladder to lock the lugs 9 will cause lateral movement or twisting of the support bar out of the plane of the ladder. As described above, the extension members 16 alleviate this when their abutment surfaces tangentially engage the sides of the support bar 13 on pivotting of the lugs 9 to locking position. In this way the support bar 13 is maintained in alignment with the side poles of the ladder.

I claim:

1. A ladder levelling device comprising an arcuate support bar terminating in ground-enqaging feet, and means for attaching the support bar to the side poles of a ladder to be supported, said attaching means including, for each side pole, a mounting bracket for attachment to the bottom end of the respective side pole and an apertured lug through which the support bar passes in sliding engagement therewith, the lug being pivotally connected to the bracket for pivotal movement in the plane of the ladder whereby it is adapted to grip the support bar and lock it to the side pole at any position at which it is set when the weight of the ladder is applied to the support bar through said attaching means, wherein each lug is formed with an extension member having an abutment surface extending parallel to the plane of the ladder, said extension member being movable in accordance with the pivotal movement of the lug to bring the abutment surface into tangential engagement with the support bar to prevent tilting of the ladder relative to the support bar when the lug is moved to the locking position.

2. A ladder levelling device according to claim 1, wherein each lug is formed with a pair of said extension members having opposed abutment surfaces which are brought into tangential engagement with opposite sides of the support bar when the lug is moved to the locking position.

3. A ladder levelling device according to claim 1 or claim 2, wherein the support bar is tubular and of circular cross section.

4. A ladder levelling device according to claim 1 or claim 2, wherein said attaching means include means for resiliently biasing the pivoted lugs to a non-locking position for freeing the arcuate support bar.

5. A ladder levelling device according to claim 1 or claim 2, wherein the aperture of each lug provides a pair of non-coplanar upper and lower gripping edges adapted to grip upper and lower regions of the support bar when the lug is in the locking position.

6. A ladder levelling device according to claim 1 or claim 2, wherein the aperture of each lug provides a pair of co-planar gripping edges adapted to grip upper and lower regions of the support bar when the lug is in the locking position.

7. A ladder levelling device comprising an arcuate support bar terminating in ground-engaging feet, and means for attaching the support bar to the side poles of a ladder to be supported, said means including, for each side pole, a mounting bracket for attachment to the bottom end of the respective side pole and an apertured lug through which the support bar passes in sliding engagement therewith, the lug being pivotally connected to the bracket for pivotal movement in the plane of the ladder whereby it is adapted to grip the support bar and lock it to the side pole at any position at which it is set when the weight of the ladder is applied to the support bar through said attaching means, wherein the aperture of each lug is non-circular and the arcuate support bar is of complementary non-circular cross-section.

* * * * *